US008225720B2

(12) United States Patent
Smith

(10) Patent No.: US 8,225,720 B2
(45) Date of Patent: Jul. 24, 2012

(54) FRICTION DAMPING SYSTEM FOR A RAILWAY TRUCK

(75) Inventor: Barnaby J. Smith, Kingston (CA)

(73) Assignee: Restruk Technologies Inc., Kingston (CA)

( * ) Notice: Subject to any disclaimer, the term of this patent is extended or adjusted under 35 U.S.C. 154(b) by 193 days.

(21) Appl. No.: 12/693,541

(22) Filed: Jan. 26, 2010

(65) Prior Publication Data

US 2010/0186621 A1 Jul. 29, 2010

Related U.S. Application Data

(60) Provisional application No. 61/147,339, filed on Jan. 26, 2009.

(51) Int. Cl.
*B61F 5/12* (2006.01)

(52) U.S. Cl. ..... 105/198.5; 105/198.4

(58) Field of Classification Search ..... 105/197.05, 105/198.2, 198.4, 198.5, 197.1, 197.2
See application file for complete search history.

(56) References Cited

U.S. PATENT DOCUMENTS

| | | | | |
|---|---|---|---|---|
| 2,377,178 A | | 5/1945 | Pierce | |
| 2,723,630 A | * | 11/1955 | Settles | 105/198.2 |
| 3,079,873 A | * | 3/1963 | Tack et al. | 105/206.1 |
| 3,254,613 A | * | 6/1966 | Weber | 105/198.2 |
| 3,450,063 A | | 6/1969 | Shafer | |
| 3,862,606 A | | 1/1975 | Scales | |
| 3,886,871 A | | 6/1975 | Ross et al. | |
| 4,108,080 A | | 8/1978 | Garner et al. | |
| 4,130,066 A | | 12/1978 | Mulcahy | |
| 4,426,934 A | | 1/1984 | Geyer | |
| 4,570,544 A | * | 2/1986 | Smith | 105/165 |
| 4,574,708 A | | 3/1986 | Solomon | |
| 4,913,062 A | | 4/1990 | Burke | |
| 5,176,083 A | | 1/1993 | Bullock | |
| 5,746,134 A | | 5/1998 | Scheffel | |

(Continued)

FOREIGN PATENT DOCUMENTS

CA 2473264 A1 1/2005

(Continued)

OTHER PUBLICATIONS

International Search Report of PCT/CA2010/000118, May 4, 2010, Breton, Eric E.

(Continued)

*Primary Examiner* — S. Joseph Morano
*Assistant Examiner* — Zachary Kuhfuss
(74) *Attorney, Agent, or Firm* — Osler, Hoskin & Harcourt LLP

(57) ABSTRACT

A railway truck has two wheel sets, a bolster, and two side frames each having a bolster opening. At least one friction plate is connected to one of the bolster openings, a car body, and end portions of the bolster and extends generally vertically. Two suspension assemblies operatively connect the bolster to the side frames. Each suspension assembly includes at least one load supporting spring biasing a corresponding end portion of the bolster upwardly, two wedges disposed on either side of the at least one friction plate, and two springs biasing the wedges. Each wedge has a generally vertical and a sloping face. The two springs bias the sloping faces of the wedges against corresponding sloping faces provided in one of the bolster openings and end portions of the bolster such that the generally vertical faces of the wedges are pressed into contact with the at least one friction plate.

24 Claims, 9 Drawing Sheets

U.S. PATENT DOCUMENTS

| | | | |
|---|---|---|---|
| 5,850,795 | A | 12/1998 | Taillon |
| 6,227,122 | B1 | 5/2001 | Spencer |
| 6,439,130 | B1 | 8/2002 | Scheffel |
| 6,581,527 | B2 | 6/2003 | Hewitt |
| 6,910,426 | B2 | 6/2005 | Krishnaswami |
| 7,025,002 | B2 | 4/2006 | Cummings |
| 7,096,795 | B2 | 8/2006 | Wike |

FOREIGN PATENT DOCUMENTS

| | | | |
|---|---|---|---|
| DE | 19507021 | A1 | 9/1996 |

OTHER PUBLICATIONS

Barber TechCare Maintenance Manual; Barber Standard Car Truck Company; http://www.sctco.com/manuals.html, Sep. 2004.

* cited by examiner

FRICTION DAMPING SYSTEM FOR A RAILWAY TRUCK

CROSS-REFERENCE

The present application claims priority to U.S. Provisional Patent Application No. 61/147,339, filed Jan. 26, 2009, the entirety of which is incorporated herein by reference.

FIELD OF THE INVENTION

The present invention relates to railway truck damping systems and to railway trucks incorporating same.

BACKGROUND OF THE INVENTION

A typical railcar includes a car body that rides on one or more railway trucks, also known as bogies. The trucks support the car body vertically and laterally while allowing sufficient rotational movement between the trucks and car body to allow negotiation of curved track.

The trucks are generally proximate to each end of the car body and support the car body for transport along the rail through a suspension system. Each truck generally includes a frame that connects two or more wheel-sets. The frame includes a pair of side frames that extend along the length of each side of the truck. A bolster connects the side frames to hold the side-frames generally parallel to one another.

In the case of freight car trucks in particular, it is common practice in North America, as well as in other jurisdictions, for the suspension system to consist of a set of steel coil springs supporting the load of the car body and an arrangement of springs and wedges to provide friction damping of both vertical and lateral motions of the car body.

A typical friction damper arrangement 1 is shown in FIG. 1. As can be seen, two vertical wear plates 2 are mounted in the bolster opening 3 of the side frame 4 and a pair of friction wedges 5 is pressed into contact with these plates 2. Sloping faces 6 on the wedges 5 contact similar sloping faces 7 on the bolster 8 and the action of springs 9 pressing the wedges 5 into contact with those sloping surfaces 7 causes the wedges 5 to press outwards against the vertical wear plates 2. Each side frame 4 is provided with this friction damper arrangement 1.

This arrangement is known as variable friction damping, since the forces on the wedges 5 from the springs 9 vary with the height of the bolster 8 within the bolster opening 3 and that, as a result of this, the friction forces between the wedges 5 and the wear plates 2 also vary.

There are two main variations of this type of arrangement. In the first of these variations, the springs are disposed between the wedges and surfaces of the bolster, and thus the spring forces do not vary as the height of the bolster varies. In the second of these variations, the bolster has a vertical face on each of its sides and the wedges act against sloping faces in the side frame. In this variation, since the springs still react against the side frame, there is no motion of the wedge as the bolster moves, and as a result, there is no variation of the spring and friction forces.

By arranging the wedges as mentioned above, a 'squaring' effect is obtained between the bolster and the two side frames of the railway truck. In many trucks, the only connection between one side frame and the other is that provided by the bolster, and the only connection between the bolster and the side frames is that provided by the wedges. The wedges are longitudinally spaced apart from each other as shown in FIG. 1 in order to prevent the side frame/bolster connection from rotating, thus allowing the side frames to move longitudinally relative to each other. The wedges also have a significant amount of pressure applied to them by the springs in order to prevent the undesirable rotation at that connection.

However, by using the wedges to accomplish tasks within the truck other than damping, their effectiveness as suspension dampers is compromised. The required spacing of the wedges, the forces applied to them, and their width, when sufficient to provide stability of the truck frame, create an undesirable level of resistance to truck vertical twist, thus compromising the equalisation of wheel loads, and provide excessive damping for the suspension, resulting in the suspension being 'locked up' for much of the time. These factors prevent truck designers from optimizing the damping qualities of the suspension and they degrade the safety and dynamic characteristics of the truck.

Also, with this type of arrangement, the 'squaring' of the truck varies with the level of wear at the wedges and the loads on the springs. This can have adverse effects on the ability of the truck to travel at high speeds and also on its ability to negotiate curved track. These factors combined with the above-noted adverse effect on the wheel vertical loads can create, in extreme cases, a situation where derailment of the truck can occur, adversely affecting the safety of the railroad operation.

Therefore, there is a need for a railway truck having a damping system which offers less resistance to truck vertical twist.

SUMMARY OF THE INVENTION

It is an object of the present invention to ameliorate at least some of the inconveniences present in the prior art.

It is also an object of the present invention to provide a railway truck having a bolster connected to friction damping systems which each include two spring biased wedges disposed on either side of a vertically extending friction plate. The springs bias the wedges such that the wedges are pressed into contact with the friction plate.

In one aspect, a railway truck for supporting a car body has a pair of side frames, each side frame having a bolster opening, two wheel-sets operatively connected to the side frames, each wheel-set including an axle and two wheels disposed on the axle, a bolster extending between the pair of side frames, the bolster having two end portions, each end portion of the bolster being disposed inside the bolster opening of a corresponding side frame, at least one friction plate connected to the end portions of the bolster and extending generally vertically downwardly therefrom, and two suspension assemblies operatively connecting the end portions of the bolster to the side frames. Each suspension assembly includes at least one load supporting spring adapted to bias the car body upwardly, a first wedge disposed on a first side of the at least one friction plate, the first wedge having a generally vertical face and a sloping face, a first spring biasing the first wedge vertically downwardly into contact with a first frame sloping face provided in the bolster opening of the corresponding side frame such that the generally vertical face of the first wedge is pressed into contact with the at least one friction plate, a second wedge disposed on a second side of the at least one friction plate opposite the first side, the second wedge having a generally vertical face and a sloping face, and a second spring biasing the second wedge vertically downwardly into contact with a second frame sloping face provided in the bolster opening of the corresponding side frame such that the generally vertical face of the second wedge is pressed into contact with the at least one friction plate.

In a further aspect, the at least one friction plate is disposed generally at a longitudinal center of the side frames.

In an additional aspect, the first and second frame sloping faces of each side frame are defined in each side frame by the bolster openings.

In a further aspect, for each side frame, the first frame sloping face is formed by a third wedge connected to a first side of the bolster opening on the first side of the at least one friction plate, and the second frame sloping face is formed by a fourth wedge connected to a second side of the bolster opening on the second side of the at least one friction plate.

In an additional aspect, for each suspension assembly, a slope of the first frame sloping face corresponds to a slope of the sloping face of the first wedge, and a slope of the second frame sloping face corresponds to a slope of the sloping face of the second wedge.

In a further aspect, for each suspension assembly, the first spring extends between and abuts the first wedge and a bottom surface of the corresponding end portion of the bolster, and the second spring extends between and abuts the second wedge and the bottom surface of the corresponding end portion of the bolster.

In an additional aspect, for each suspension assembly, the first spring extends between and abuts the first wedge and a bottom surface of a first projection of the corresponding side frame, and the second spring extends between and abuts the second wedge and a bottom surface of a second projection of the corresponding side frame.

In a further aspect, at least one first wear plate is connected to one side of the at least one friction plate, and at least one second wear plate is connected to another side of the at least one friction plate. For each suspension assembly, the vertical face of the first wedge is pressed into contact with the at least one first wear plate, and the vertical face of the second wedge is pressed into contact with the at least one second wear plate.

In an additional aspect, the at least one friction plate is integrally formed with the bolster, and the bolster has a generally T-shaped cross-section.

In a further aspect, a width of the at least one friction plate is less than a width of the bolster.

In an additional aspect, one of a bracing system, a shear frame, and a frame structure connects the side frames together.

In a further aspect, for each suspension assembly, the at least one load supporting spring biases the corresponding end portion of the bolster upwardly.

In another aspect, a railway truck for supporting a car body has a pair of side frames, each side frame having a bolster opening, each bolster opening having a bottom wall, two wheel-sets operatively connected to the side frames, each wheel-set including an axle and two wheels disposed on the axle, a bolster extending between the pair of side frames, the bolster having two end portions, each end portion of the bolster being disposed inside the bolster opening of a corresponding side frame, two friction plates connected to the bottom walls of the bolster openings and extending generally vertically upwardly therefrom, and two suspension assemblies operatively connecting the end portions of the bolster to the side frame. Each suspension assembly includes at least one load supporting spring adapted to bias the car body upwardly, a first wedge disposed on a first side of a corresponding friction plate, the first wedge having a generally vertical face and a sloping face, a first spring biasing the first wedge vertically upwardly into contact with a first bolster sloping face provided by the corresponding end portion of the bolster such that the generally vertical face of the first wedge is pressed into contact with the corresponding friction plate, a second wedge disposed on a second side of the corresponding friction plate opposite the first side, the second wedge having a generally vertical face and a sloping face, a second spring biasing the second wedge vertically upwardly into contact with a second bolster sloping face provided by the corresponding end portion of the bolster such that the generally vertical face of the second wedge is pressed into contact with the corresponding friction plate.

In an additional aspect, the two friction plates are disposed generally at a longitudinal center of the side frames.

In a further aspect, the first and second bolster sloping faces of each end portion of the bolster are defined by the bolster.

In an additional aspect, for each suspension assembly, a slope of the first bolster sloping face corresponds to a slope of the sloping face of the first wedge, and a slope of the second bolster sloping face corresponds to a slope of the sloping face of the second wedge.

In a further aspect, for each suspension assembly, the first spring extends between and abuts the first wedge and the bottom wall of the corresponding bolster opening, and the second spring extends between and abuts the second wedge and the bottom wall of the corresponding bolster opening.

In an additional aspect, for each suspension assembly, the first spring extends between and abuts the first wedge and an upper surface of a first projection of the corresponding end portion of the bolster, and the second spring extends between and abuts the second wedge and an upper surface of a second projection of the corresponding end portion of the bolster.

In a further aspect, at least two first wear plates are connected to one side of the two friction plates, and at least two second wear plates are connected to another side of the two friction plates. For each suspension assembly, the vertical face of the first wedge is pressed into contact with a corresponding one of the at least two first wear plates, and the vertical face of the second wedge is pressed into contact with a corresponding one of the at least two second wear plates.

In an additional aspect, the two friction plates are integrally formed with the side frames.

In a further aspect, a width of each of the two friction plates is less than a width of the bolster.

In an additional aspect, one of a bracing system, a shear frame, and a frame structure connects the side frames together.

In a further aspect, for each suspension assembly, the at least one load supporting spring biases the corresponding end portion of the bolster upwardly.

In yet another aspect, a railway truck for supporting a car body has a pair of side frames, each side frame having a bolster opening, two wheel-sets operatively connected to the side frames, each wheel-set including an axle and two wheels disposed on the axle, a bolster extending between the pair of side frames, the bolster having two end portions, each end portion of the bolster being disposed inside the bolster opening of a corresponding side frame, at least one friction plate adapted for connection to the car body and for extending generally vertically downwardly therefrom, and two suspension assemblies operatively connecting the end portions of the bolster to the side frames. Each suspension assembly includes, at least one load supporting spring adapted to bias the car body upwardly, a first wedge disposed on a first side of the at least one friction plate, the first wedge having a generally vertical face and a sloping face, a first spring biasing the first wedge vertically downwardly into contact with a first frame sloping face provided in the bolster opening of the corresponding side frame such that the generally vertical face of the first wedge is pressed into contact with the at least one friction plate, a second wedge disposed on a second side of the at least one friction plate opposite the first side, the second wedge having a generally vertical face and a sloping face, and a second spring biasing the second wedge vertically downwardly into contact with a second frame sloping face provided in the bolster opening of the corresponding side frame such that the generally vertical face of the second wedge is pressed into contact with the at least one friction plate.

Embodiments of the present invention each have at least one of the above-mentioned objects and/or aspects, but do not necessarily have all of them. It should be understood that some aspects of the present invention that have resulted from attempting to attain the above-mentioned objects may not satisfy these objects and/or may satisfy other objects not specifically recited herein.

Additional and/or alternative features, aspects, and advantages of embodiments of the present invention will become apparent from the following description, the accompanying drawings, and the appended claims.

BRIEF DESCRIPTION OF THE DRAWINGS

For a better understanding of the present invention, as well as other aspects and further features thereof, reference is made to the following description which is to be used in conjunction with the accompanying drawings, where.

DETAILED DESCRIPTION OF THE EMBODIMENTS

Reference will now be made in detail to present embodiments of the invention, one or more examples of which are illustrated in the accompanying drawings. Each example is provided by way of explanation of the invention, not limitation of the invention. In fact, it will be apparent to those skilled in the art that modifications and variations can be made in the present invention without departing from the scope or spirit thereof. For instance, features illustrated or described as part of one embodiment may be used on another embodiment to yield a still further embodiment. Thus, it is intended that the present invention covers such modifications and variations as come within the scope of the appended claims and their equivalents.

Figure 1:
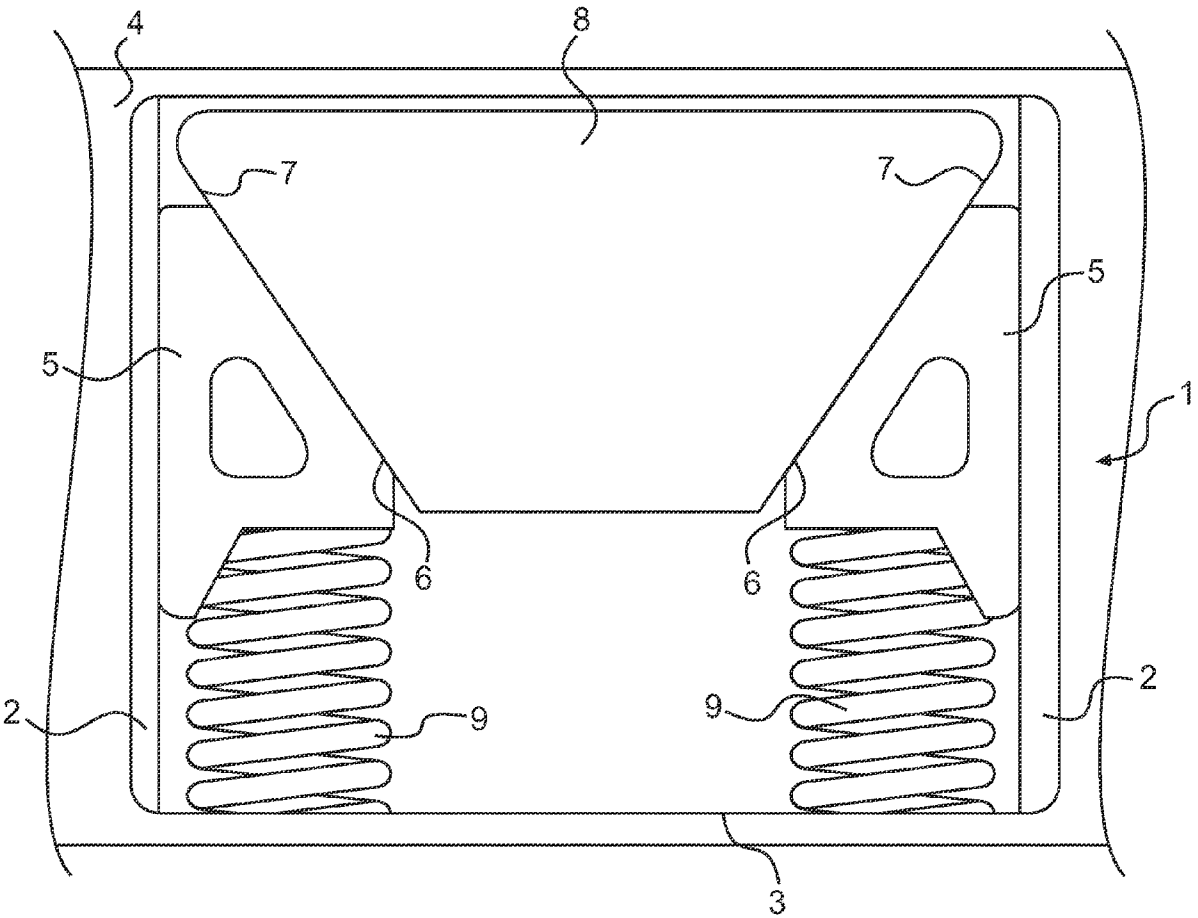
FIG. 1 PRIOR ART
FIG. 1 is a schematic side elevation view of a prior art railway car friction damping system.
Figure 2:
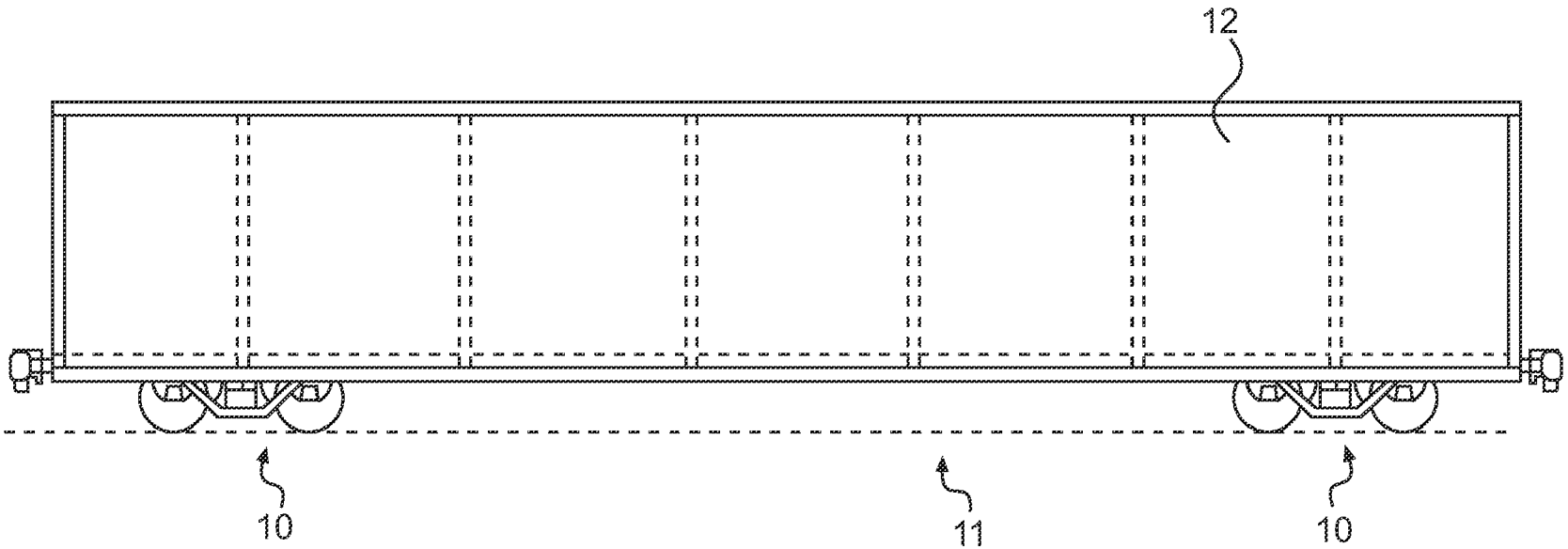
FIG. 2 is a side elevation view of a railcar.

As shown in FIG. 2, a railcar 11 has a car body 12 that rests on a pair of railway trucks 10. It is contemplated that only one or more than two trucks 10 could also be provided. The car body 12 shown in FIG. 2 is a freight container, however it is contemplated that the car body could be a passenger compartment, a locomotive body, or any other type of vehicle used for transport by rail. The railway trucks 10 support the car body 12 vertically and pivotally for allowing slight rotational movement between the trucks 10 and car body 12.

Figure 3:
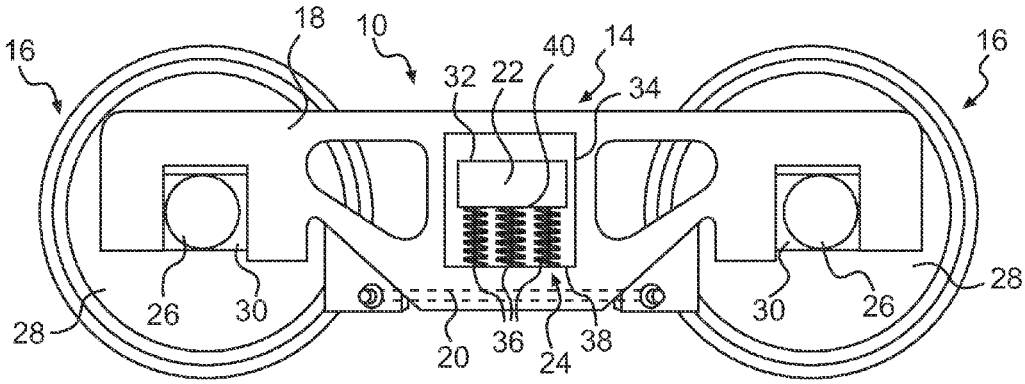
FIG. 3 is a side elevation view of a railway truck of the railcar of FIG. 2.
Figure 4:
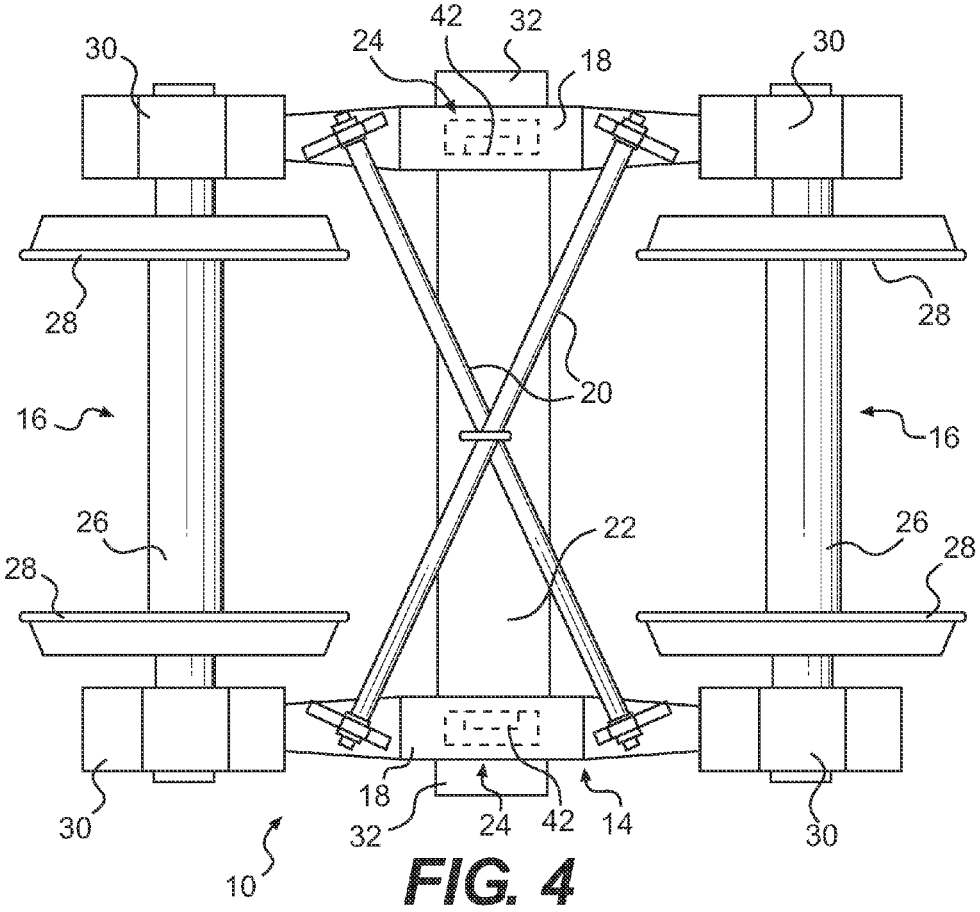
FIG. 4 is a bottom plan view of the railway truck of FIG. 3.

Turning now to FIGS. 3 and 4, one of the railway trucks 10 will be described. The other of the railway trucks 10 has a similar construction, and as such will not be described. The railway truck 10 includes a frame 14 and two wheel-sets 16. The frame 14 includes a pair of side frames 18 that extend along the length of each side of the railway truck 10. A bracing system including a pair of diagonally extending struts 20 connects to the side frames 18 to hold the side frames 18 generally parallel to one another and to resist longitudinal motion between the side frames 18. Additional details regarding a bracing system of this type may be found in U.S. Pat. No. 4,570,544, issued Feb. 18, 1986, the entirety of which is incorporated herein by reference. It is contemplated that the bracing system could be replaced by a shear frame or other frame structure. A bolster 22 extends from one side frame 18 to the other and pivotally supports the car body 12. Two suspension assemblies 24 located on the side frames 18 (one suspension assembly 24 per side frame 28) are connected to the bolster 22 to reduce the transmission of vibrations from the truck 10 to the car body 12. The suspension assemblies 24 will be described in greater detail below.

Each wheel-set 16 includes an axle 26, a pair of conical wheels 28, and bearing assemblies 30. The bearing assemblies 30 preferably each include a tapered roller bearing. However, it is contemplated that other types of bearings could be used. The conical wheels 28 are fixedly connected to the axles 26 proximate each end of the axles 26. In this manner, the conical wheels 28 rotate at the same speed as the axles 26. The bearing assemblies 30 are outboard of each conical wheel 28 to operably connect each wheel-set 16 to the side frames 18 so that the axles 26 and wheels 28 rotate freely as the truck 10 travels along the rails. It should be understood by one of ordinary skill in the art that alternate designs are contemplated and include other physical arrangements between the axle 26, conical wheels 28, and bearing assemblies 30. For example, the bearing assemblies 30 may be located inboard of the conical wheels 28. Alternatively, the conical wheels 28 may be operably connected to the axle 26, with or without bearings, to allow the wheels 28 to rotate separately from the axles 26.

The suspension assemblies 24 will now be described in more detail. As can be seen in FIGS. 3 and 4, the end portion 32 of the bolster 22 extend through openings, called bolster openings 34, defined in each of the side frames 18. Each suspension assembly 24 includes a plurality of load supporting springs 36 disposed between a bottom wall 38 of the corresponding bolster opening 34 and a bottom surface 40 of a corresponding end portion 32 of the bolster 22. The load supporting springs 36 bias the bolster 22 upwardly to support the weight of the car body 12. It is contemplated that the weight of the car body 12 could alternatively be borne by the load supporting springs 36 acting directly on the underside of the car body 12. In embodiments where the weight of the car body 12 is borne by the load supporting springs 36, it is contemplated that sliders, rollers, or other mechanisms could be provided between the load supporting springs 36 and the underside of the car body 12 to allow for the swivel motion of the car body 12 relative to the railway truck 10. The load supporting springs 36 are single or dual steel coil springs. However it is contemplated that other types of springs could be used. It is contemplated that recesses and/or protrusions can be provided on the bottom walls 38 of the bolster openings 34 and/or on the bottom surfaces of the end portions 32 of the bolster 22 to help prevent displacement of the load supporting springs 36. It is also contemplated that more or less load supporting springs 36 than the number illustrated in FIG. 3 could be provided.

Each suspension assembly 24 also has a friction damping system 42. The friction damping systems 42 are disposed laterally inwardly of the load supporting springs 36. However it is contemplated that the friction damping systems 42 could be disposed laterally outwardly of the load supporting springs 36 or that load supporting springs 36 could be disposed on both sides of the friction damping systems 42. The friction damping systems 42, as their name suggest, provide frictional damping of the motion of the bolster 22 resulting from the motion of the car body 12 relative to the side frames 18.

Turning to FIGS. 5 to 10, various embodiments of the friction damping systems 42 (friction damping systems 42A to 42F respectively) to be used in the railway truck 10 will now be described. For simplicity, like elements have been labelled with the same reference numerals, with the addition of a suffix corresponding to the specific embodiment.

Figure 5:
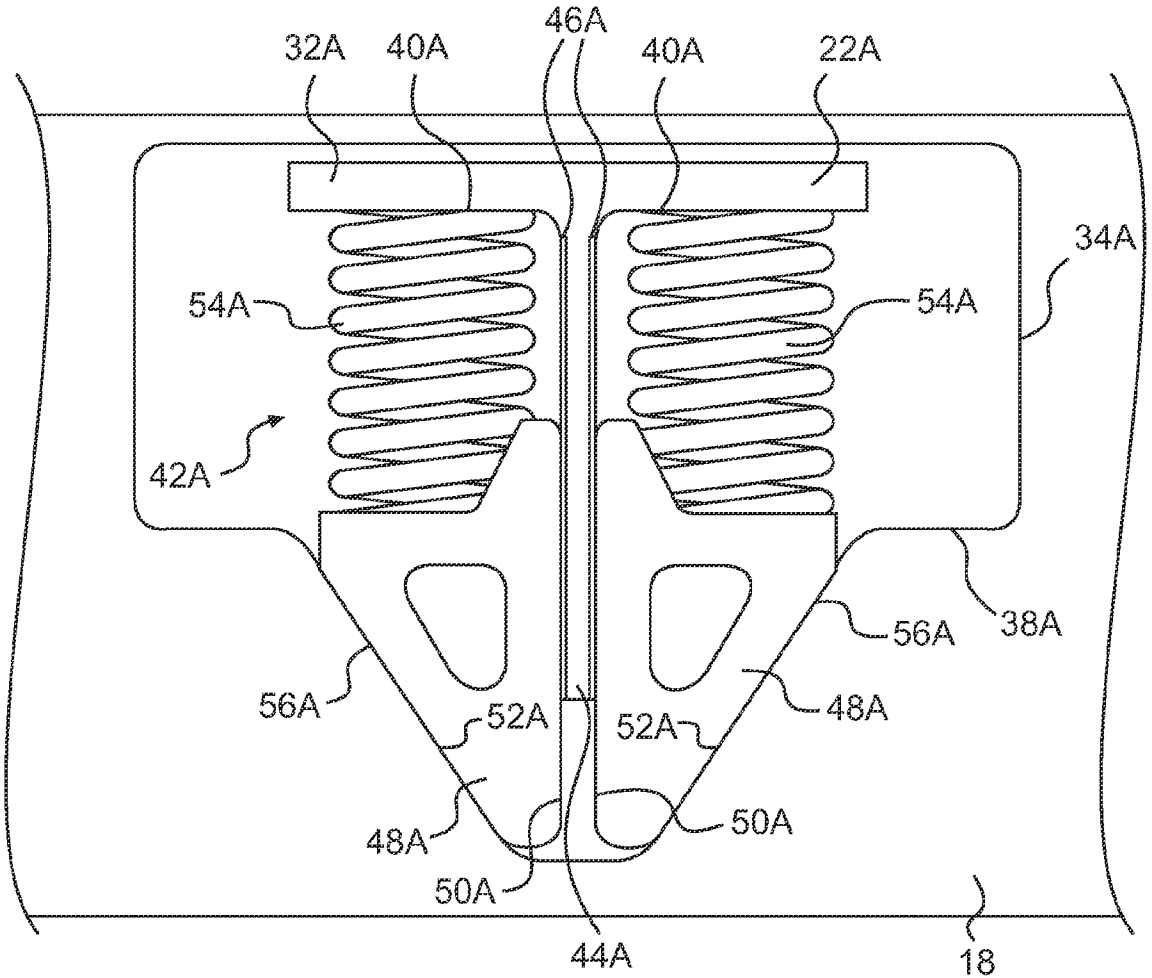
FIG. 5 is a schematic side elevation view of a first embodiment of a railway car friction damping system of the railway truck of FIG. 3.

The friction damping system 42A will now be described with reference to FIG. 5. A friction plate 44A is connected to the end portion 32A of the bolster 22A and extends generally vertically downwardly therefrom. As can be seen, the friction plate 44A is narrower than the bolster 22A and is disposed generally at the center of the bolster 22A, which generally corresponds to a longitudinal center of the side frame 18. The friction plate 44A is integrally formed with the bolster 22A, which, as a result, has a generally T-shaped cross-section where the friction plate 44A is located. It is contemplated that the friction plate 44A could alternatively be fastened, welded, or otherwise mechanically connected to the bolster 22A. Each of the two friction damping systems 42A used on the railway truck 10 is provided with its own friction plate 44A. However, it is contemplated that only one friction plate 44A extending from one end portion 32A of the bolster 22A to the other could be provided and be used by both friction damping systems 42A. A wear plate 46A is connected to each side of the friction plate 44A. It is contemplated that the wear plates 46A could be omitted.

The friction damping system 42A has two wedges 48A. Each wedge 48A has a generally vertical face 50A and a sloping face 52A. It is contemplated that wear plates could be connected to the vertical faces 50A of the wedges 48A. As can be seen, the wedges 48A are disposed on either side of the friction plate 44A such that their faces 50A face each other. Two springs 54A each have one end abutting the bottom surface 40A of the end portion 32A of the bolster 22A and another end abutting a corresponding one of the wedges 48A so as to bias the wedges 48A vertically downwardly away from the bolster 22A. The springs 54A are single or dual steel coil springs. However, it is contemplated that other types of springs could be used. It is contemplated that recesses and/or protrusions can be provided on the wedges 48A and/or on the bottom surface 40A of the end portion 32A of the bolster 22A to help prevent displacement of the springs 54A.

As can be seen, the springs 54A bias the sloping faces 52A of the wedges 48A into contact with frame sloping faces 56A defined in the side frame 18 by the bolster opening 34A and having slopes corresponding to slopes of the sloping faces 52A. As a result, the vertical faces 50A of the wedges 48A are pressed into contact with the wear plates 46A. The resulting friction forces dampen the motion of the suspension assembly 24. Since the springs 54A get compressed by the bolster 22A, the amount of force applied by the springs 54A varies with the amount of compression, and therefore the amount of friction damping provided by the friction damping system 42A also varies.

Figure 6:
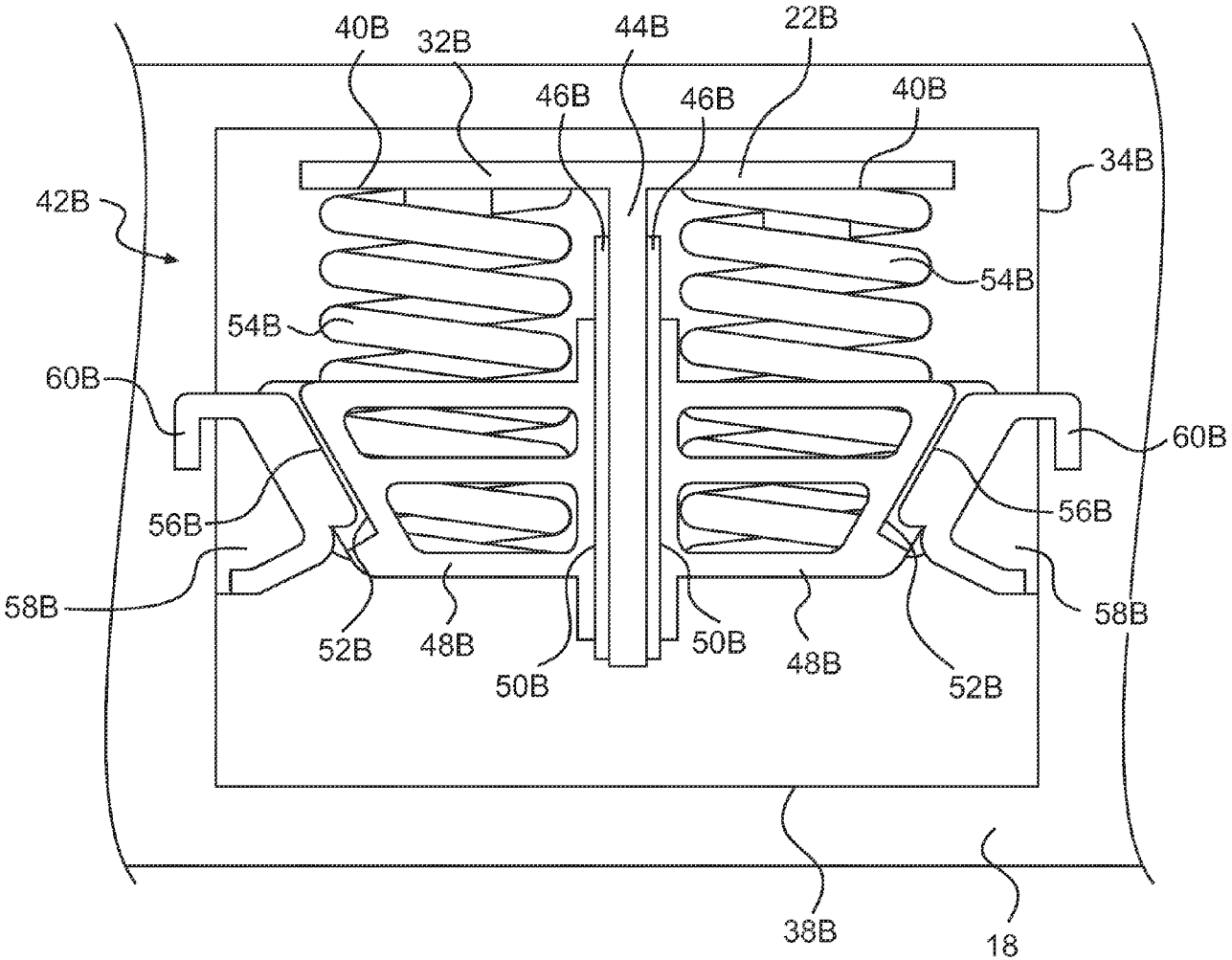
FIG. 6 is a schematic side elevation view of a second embodiment of a railway car friction damping system of the railway truck of FIG. 3.

The friction damping system 42B will now be described with reference to FIG. 6. A friction plate 44B is connected to the end portion 32B of the bolster 22B and extends generally vertically downwardly therefrom. As can be seen, the friction plate 44B is narrower than the bolster 22B and is disposed generally at the center of the bolster 22B, which generally corresponds to a longitudinal center of the side frame 18. The friction plate 44B is integrally formed with the bolster 22B, which, as a result, has a generally T-shaped cross-section where the friction plate 44B is located. It is contemplated that the friction plate 44B could alternatively be fastened, welded, or otherwise mechanically connected to the bolster 22B. Each of the two friction damping systems 42B used on the railway truck 10 is provided with its own friction plate 44B. However, it is contemplated that only one friction plate 44B extending from one end portion 32B of the bolster 22B to the other could be provided and be used by both friction damping systems 42B. A wear plate 46B is connected to each side of the friction plate 44B. It is contemplated that the wear plates 46B could be omitted.

The friction damping system 42B has two wedges 48B. Each wedge 48B has a generally vertical face 50B and a sloping face 52B. It is contemplated that wear plates could be connected to the vertical faces 50B of the wedges 48B. As can be seen, the wedges 48B are disposed on either side of the friction plate 44B such that their faces 50B face each other. Two springs 54B each have one end abutting the bottom surface 40B of the end portion 32B of the bolster 22B and another end abutting a corresponding one of the wedges 48B so as to bias the wedges 48B vertically downwardly away from the bolster 22B. The springs 54B are single or dual steel coil springs. However it is contemplated that other types of springs could be used. It is contemplated that recesses and/or protrusions can be provided on the wedges 48B and/or on the bottom surface 40B of the end portion 32B of the bolster 22B to help prevent displacement of the springs 54B.

As can be seen, the springs 54B bias the sloping faces 52B of the wedges 48B into contact with frame sloping faces 56B defined by wedges 58B and having slopes corresponding to slopes of the sloping faces 52B. As can also be seen, the sloping faces 52B are recessed in the wedges 48B which help maintain the wedges 48B and 58B in alignment with each other. The wedges 58B are connected to the sides of the bolster opening 34B by hooks 60B inserted in openings formed in the sides of the bolster opening 34B. As a result of the sloping faces 52B of the wedges 48B being biased into contact with the frame sloping faces 56B defined by the wedges 58B, the vertical faces 50B of the wedges 48B are pressed into contact with the wear plates 46B. The resulting friction forces dampen the motion of the suspension assembly 24. Since the springs 54B get compressed by the bolster 22B, the amount of force applied by the springs 54B varies with the amount of compression, and therefore the amount of friction damping provided by the friction damping system 42B also varies.

Figure 7:
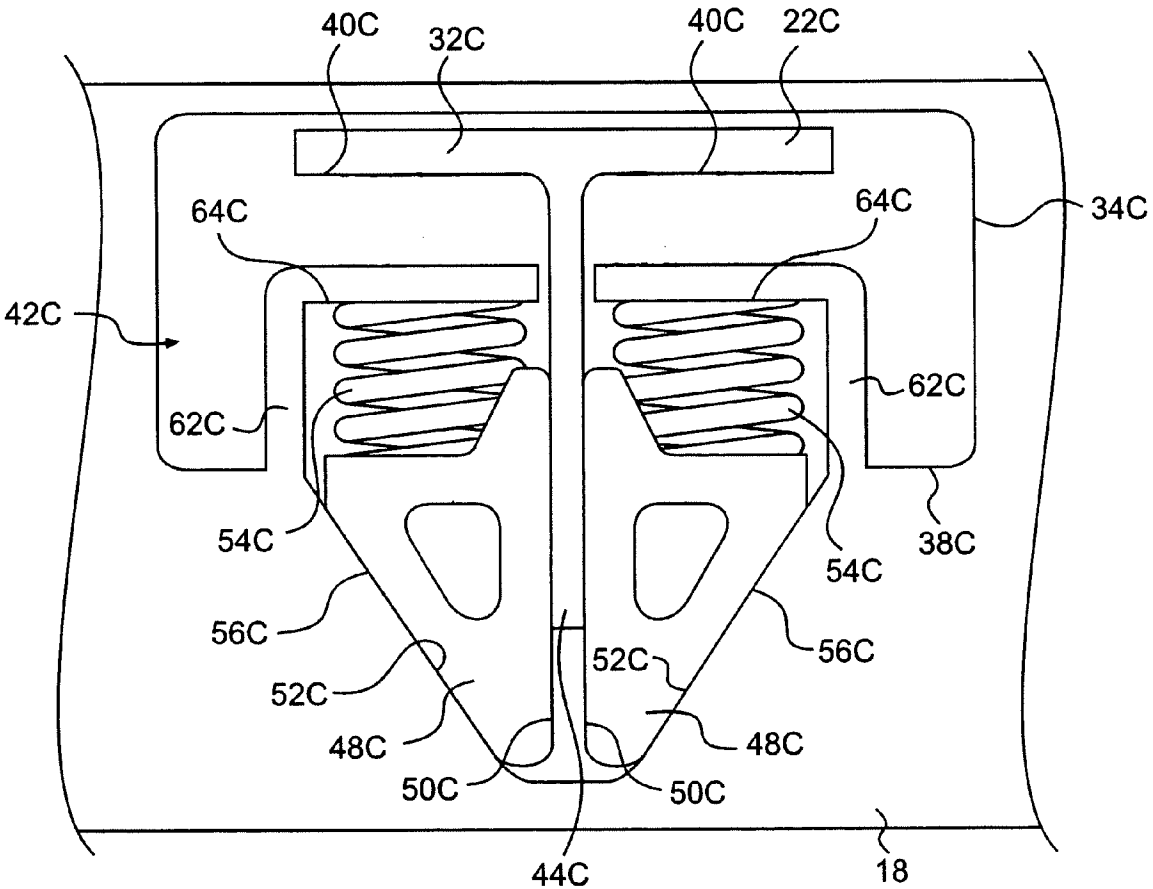
FIG. 7 is a schematic side elevation view of a third embodiment of a railway car friction damping system of the railway truck of FIG. 3.

The friction damping system 42C will now be described with reference to FIG. 7. A friction plate 44C is connected to the end portion 32C of the bolster 22C and extends generally vertically downwardly therefrom. As can be seen, the friction plate 44C is narrower than the bolster 22C and is disposed generally at the center of the bolster 22C, which generally corresponds to a longitudinal center of the side frame 18. The friction plate 44C is integrally formed with the bolster 22C, which, as a result, has a generally T-shaped cross-section where the friction plate 44C is located. It is contemplated that the friction plate 44C could alternatively be fastened, welded, or otherwise mechanically connected to the bolster 22C. Each of the two friction damping systems 42C used on the railway truck 10 is provided with its own friction plate 44C. However, it is contemplated that only one friction plate 44C extending from one end portion 32C of the bolster 22C to the other could be provided and be used by both friction damping systems 42C. It is contemplated that a wear plate could be connected to each side of the friction plate 44C. In this embodiment, the side frame 18 has two generally L-shaped projections 62C projecting inside the bolster opening 34C below the bolster 22C from the bottom wall 38C of the bolster opening 34C. It is contemplated that the projections 62C could be integrally formed or otherwise mechanically connected to the side frame 18.

The friction damping system 42C has two wedges 48C. Each wedge 48C has a generally vertical face 50C and a sloping face 52C. It is contemplated that wear plates could be connected to the vertical faces 50C of the wedges 48C. As can be seen, the wedges 48C are disposed on either side of the friction plate 44C such that their faces 50C face each other. Two springs 54C each have one end abutting a bottom surface 64C of a corresponding one of the projections 62C and another end abutting a corresponding one of the wedges 48C so as to bias the wedges 48C vertically downwardly away from the bottom surfaces 64C of the projections 62C. The springs 54C are single or dual steel coil springs. However it is contemplated that other types of springs could be used. It is contemplated that recesses and/or protrusions can be provided on the wedges 48C and/or on the bottom surfaces 64C of the projections 62C to help prevent displacement of the springs 54C.

As can be seen, the springs 54C bias the sloping faces 52C of the wedges 48C into contact with frame sloping faces 56C defined in the side frame 18 by the bolster opening 34C and having slopes corresponding to slopes of the sloping faces 52C. As a result, the vertical faces 50C of the wedges 48C are pressed into contact with the sides of the friction plate 44C. The resulting friction forces dampen the motion of the suspension assembly 24. Since the amount of compression of the springs 54C is fixed, the amount of force applied by the springs 54C is generally constant, and therefore the amount of friction damping provided by the friction damping system 42C is also generally constant.

Figure 8:
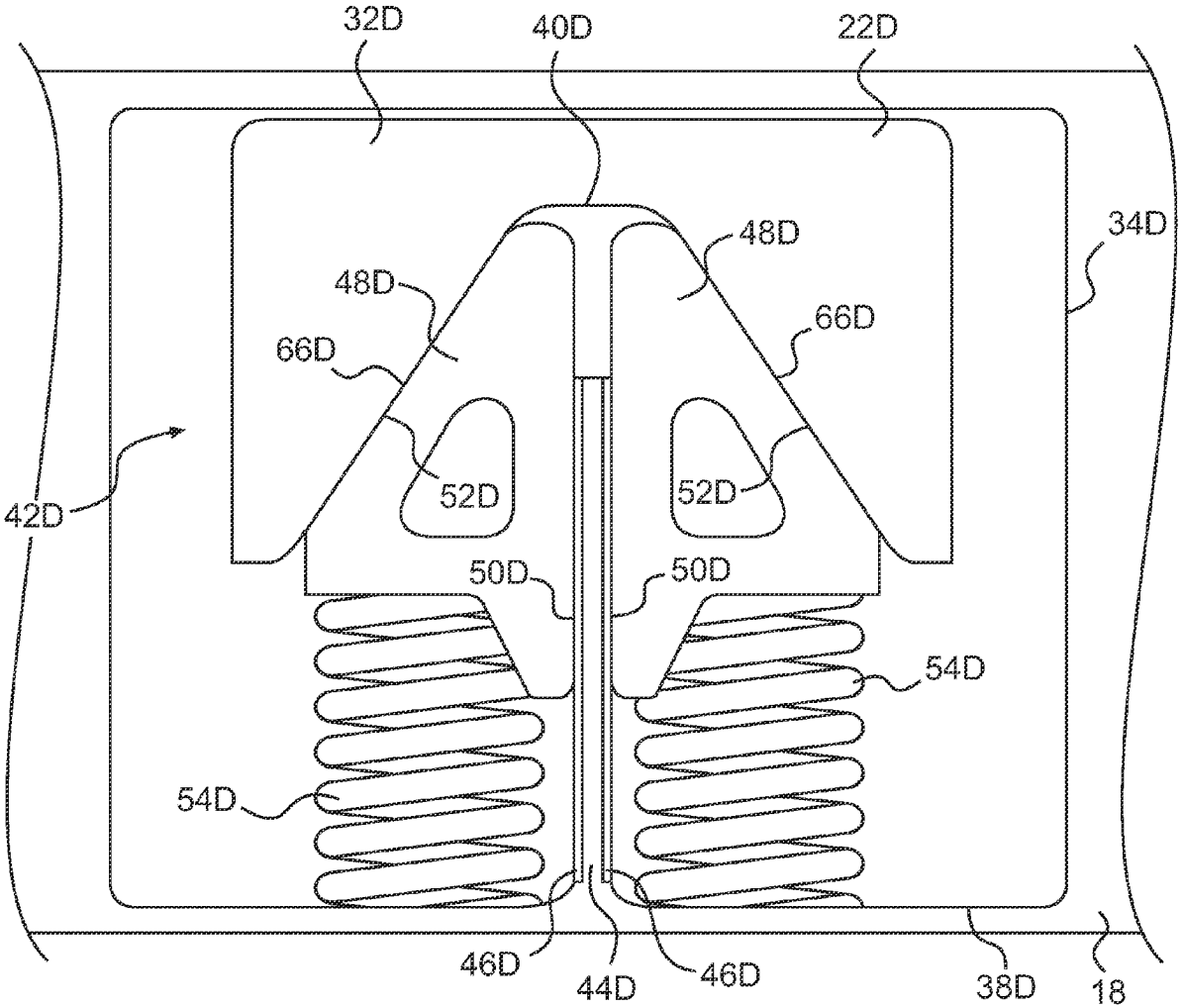
FIG. 8 is a schematic side elevation view of a fourth embodiment of a railway car friction damping system of the railway truck of FIG. 3.

The friction damping system 42D will now be described with reference to FIG. 8. A friction plate 44D is connected to the bottom wall 38D of the bolster opening 34D and extends generally vertically upwardly therefrom. As can be seen, the friction plate 44D is narrower than the bolster 22D and is generally aligned with the center of the bolster 22D, which generally corresponds to a longitudinal center of the side frame 18. The friction plate 44D is integrally formed with the side frame 18. It is contemplated that the friction plate 44D could alternatively be fastened, welded, or otherwise mechanically connected to the bottom wall 38D of the bolster opening 34D. Each of the two friction damping systems 42D used on the railway truck 10 is provided with its own friction plate 44D. A wear plate 46D is connected to each side of the friction plate 44D. It is contemplated that the wear plates 46D could be omitted.

The friction damping system 42D has two wedges 48D. Each wedge 48D has a generally vertical face 50D and a sloping face 52D. It is contemplated that wear plates could be connected to the vertical faces 50D of the wedges 48D. As can be seen, the wedges 48D are disposed on either side of the friction plate 44D such that their faces 50D face each other. Two springs 54D each have one end abutting the bottom wall 38D of the bolster opening 34D and another end abutting a corresponding one of the wedges 48D so as to bias the wedges 48D vertically upwardly toward the bolster 22D. The springs 54D are single or dual steel coil springs. However, it is contemplated that other types of springs could be used. It is contemplated that recesses and/or protrusions can be provided on the wedges 48D and/or on the bottom wall 38D of the bolster opening 34D to help prevent displacement of the springs 54D.

As can be seen, the springs 54D bias the sloping faces 52D of the wedges 48D into contact with bolster sloping faces 66D defined by the bolster 22D and having slopes corresponding to slopes of the sloping faces 52D. It is contemplated that the bolster sloping faces 66D could be formed by wedges connected to the lower surface 40D of the bolster 22D. As a result, the vertical faces 50D of the wedges 48D are pressed into contact with the wear plates 46D. The resulting friction forces dampen the motion of the suspension assembly 24. Since the springs 54D get compressed by the bolster 22D, the amount of force applied by the springs 54D varies with the amount of compression, and therefore the amount of friction damping provided by the friction damping system 42D also varies.

Figure 9:
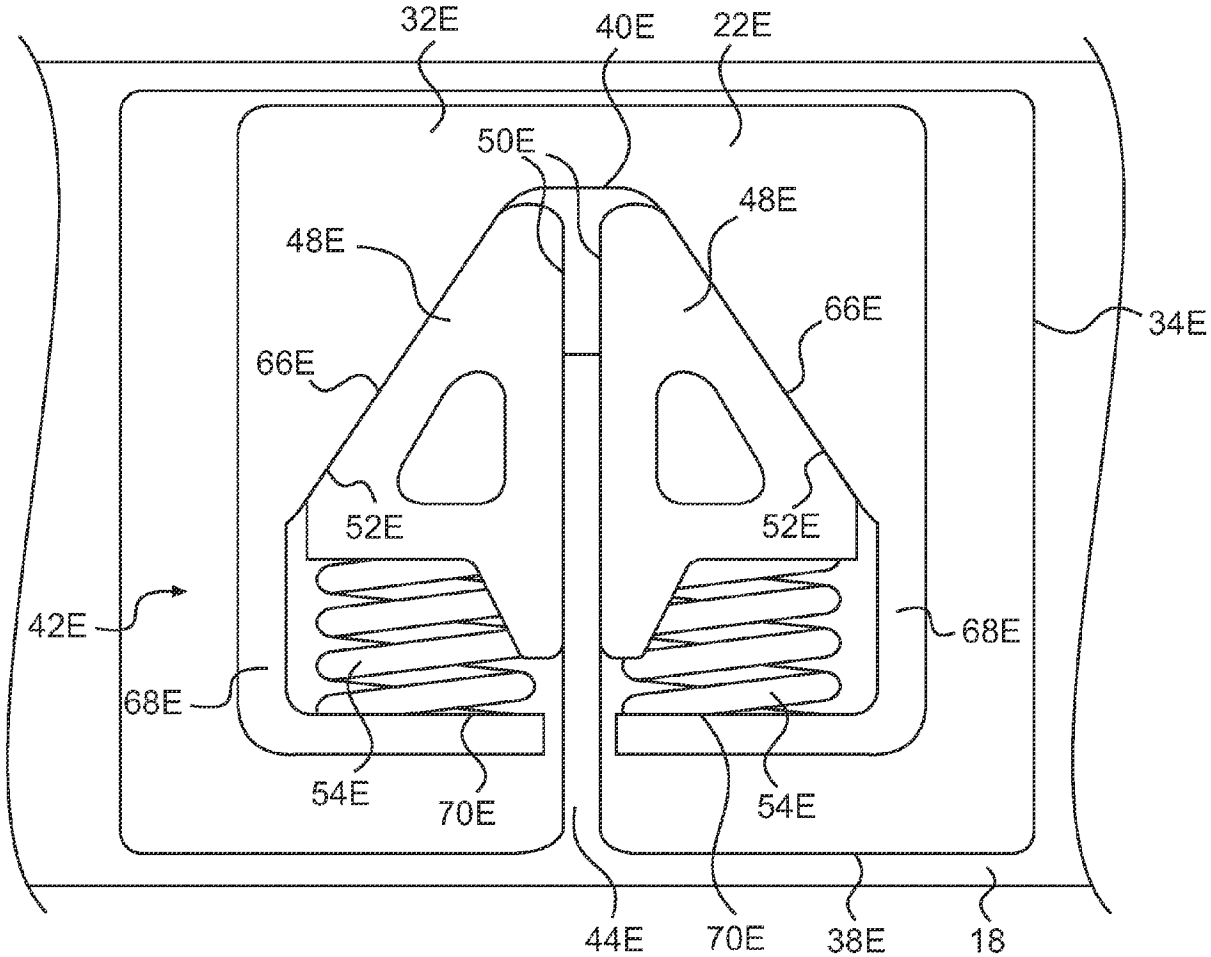
FIG. 9 is a schematic side elevation view of a fifth embodiment of a railway car friction damping system of the railway truck of FIG. 3.

The friction damping system 42E will now be described with reference to FIG. 9. A friction plate 44E is connected to the bottom wall 38E of the bolster opening 34E and extends generally vertically upwardly therefrom. As can be seen, the friction plate 44E is narrower than the bolster 22E and is generally aligned with the center of the bolster 22E, which generally corresponds to a longitudinal center of the side frame 18. The friction plate 44E is integrally formed with the side frame 18. It is contemplated that the friction plate 44E could alternatively be fastened, welded, or otherwise mechanically connected to the bottom wall 38E of the bolster opening 34E. Each of the two friction damping systems 42E used on the railway truck 10 is provided with its own friction plate 44E. It is contemplated that a wear plate could be connected to each side of the friction plate 44E. In this embodiment, the bolster 22E has two generally L-shaped projections 68E projecting therefrom below the bolster 22E. It is contemplated that the projections 68E could be integrally formed or otherwise mechanically connected to the bolster 22E.

The friction damping system 42E has two wedges 48E. Each wedge 48E has a generally vertical face 50E and a sloping face 52E. It is contemplated that wear plates could be connected to the vertical faces 50E of the wedges 48E. As can be seen, the wedges 48E are disposed on either side of the friction plate 44E such that their faces 50E face each other. Two springs 54E each have one end abutting the upper surface 70E of a corresponding one of the projections 68E and another end abutting a corresponding one of the wedges 48E so as to bias the wedges 48E vertically upwardly toward the bolster 22E. The springs 54E are single or dual steel coil springs. However it is contemplated that other types of springs could be used. It is contemplated that recesses and/or protrusions can be provided on the wedges 48E and/or on the upper surfaces 70E of the projections 68E to help prevent displacement of the springs 54E.

As can be seen, the springs 54E bias the sloping faces 52E of the wedges 48E into contact with bolster sloping faces 66E defined by the bolster 22E and having slopes corresponding to slopes of the sloping faces 52E. It is contemplated that the bolster sloping faces 66E could be formed by wedges connected to the lower surface 40E of the bolster 22E. As a result, the vertical faces 50E of the wedges 48E are pressed into contact with the sides of the friction plate 44E. The resulting friction forces dampen the motion of the suspension assembly 24. Since the amount of compression of the springs 54E is fixed, the amount of force applied by the springs 54E is generally constant, and therefore the amount of friction damping provided by the friction damping system 42E is also generally constant.

Figure 10:
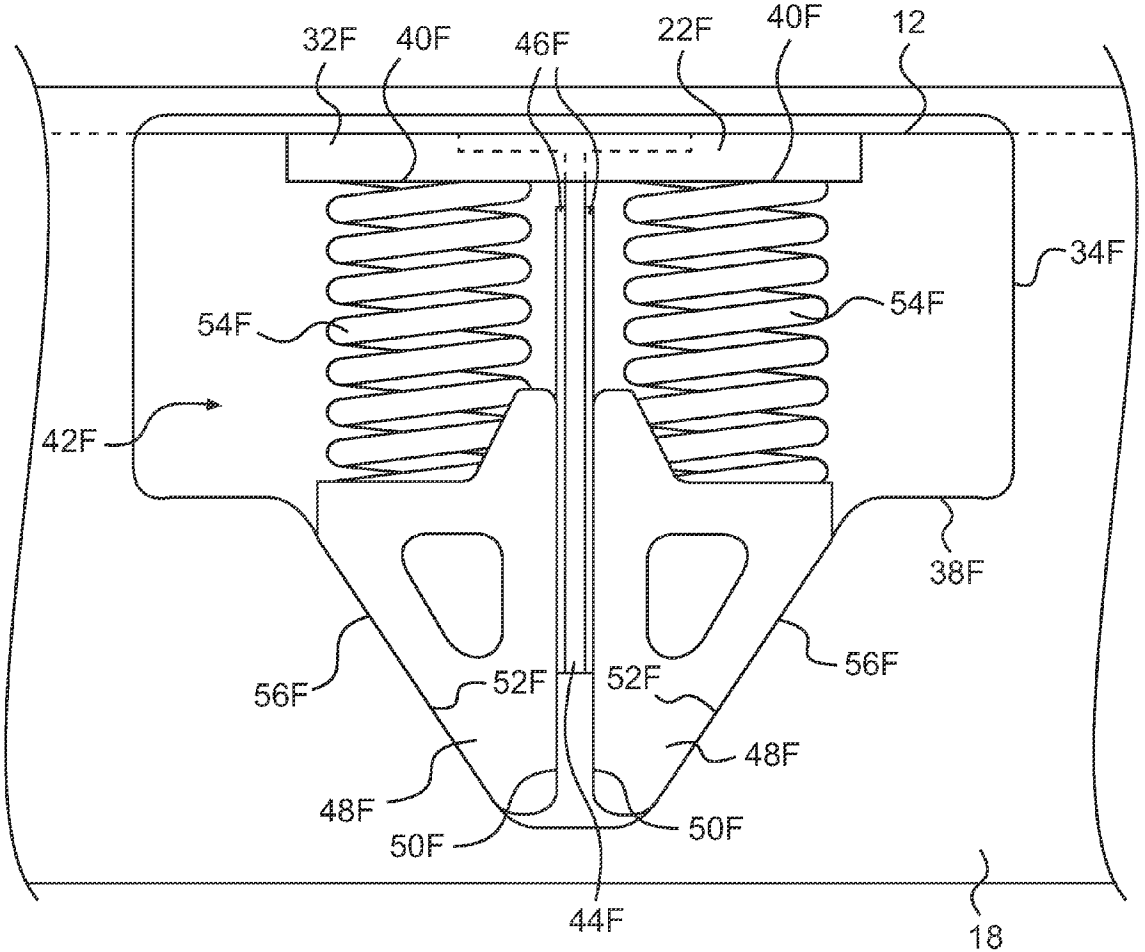
FIG. 10 is a schematic side elevation view of a sixth embodiment of a railway car friction damping system of the railway truck of FIG. 3.

The friction damping system 42F will now be described with reference to FIG. 10. A friction plate 44F is connected to the bottom of the car body 12 and extends generally vertically downwardly therefrom through the bolster 22F. It is contemplated that sliders, rollers, or other mechanisms could be provided between the friction plate 44F and the underside of the car body 12 to allow for the swivel motion of the car body 12 relative to the railway truck 10. As can be seen, the friction plate 44F is narrower than the bolster 22F and is disposed generally at the center of the bolster 22F, which generally corresponds to a longitudinal center of the side frame 18. Each of the two friction damping systems 42F used on the railway truck 10 is provided with its own friction plate 44F. However, it is contemplated that only one friction plate 44F extending from one end portion 32F of the bolster 22F to the other could be provided and be used by both friction damping systems 42F. A wear plate 46F is connected to each side of the friction plate 44F. It is contemplated that the wear plates 46A could be omitted.

The friction damping system 42F has two wedges 48F. Each wedge 48F has a generally vertical face 50F and a sloping face 52F. It is contemplated that wear plates could be connected to the vertical faces 50F of the wedges 48F. As can be seen, the wedges 48F are disposed on either side of the friction plate 44F such that their faces 50F face each other. Two springs 54F each have one end abutting the bottom surface 40F of the end portion 32F of the bolster 22F and another end abutting a corresponding one of the wedges 48F so as to bias the wedges 48F vertically downwardly away from the bolster 22F. The springs 54F are single or dual steel coil springs. However it is contemplated that other types of springs could be used. It is contemplated that recesses and/or protrusions can be provided on the wedges 48F and/or on the bottom surface 40F of the end portion 32F of the bolster 22F to help prevent displacement of the springs 54F.

As can be seen, the springs 54F bias the sloping faces 52F of the wedges 48F into contact with frame sloping faces 56F defined in the side frame 18 by the bolster opening 34F and having slopes corresponding to slopes of the sloping faces 52F. As a result, the vertical faces 50F of the wedges 48F are pressed into contact with the wear plates 46F. The resulting friction forces dampen the motion of the suspension assembly 24. Since the springs 54F get compressed by the bolster 22F, the amount of force applied by the springs 54F varies with the amount of compression, and therefore the amount of friction damping provided by the friction damping system 42F also varies.

It is contemplated that the friction damping system 42F could be provided with projections similar to the projections 62C of the friction damping system 42C for the springs 54F to abut against. As a result, the friction damping system 42F would provide a generally constant amount of friction damping.

As can be seen in the friction damping systems 42A to 42F described above, the friction wedges 48 are disposed relatively close to one another since they are only separated by a thickness of the friction plate 44 and, where applicable, of the wear plates 46. As a result, the friction damping systems 42A to 42F offer very little resistance to the twisting motion of the side frames 18. This allows the load on the wheels 28 to be equalised when traversing uneven tracks.

Modifications and improvements to the above-described embodiments of the present invention may become apparent to those skilled in the art. The foregoing description is intended to be exemplary rather than limiting. The scope of the present invention is therefore intended to be limited solely by the scope of the appended claims.

What is claimed is:

1. A railway truck for supporting a car body comprising:

a pair of side frames, each side frame having a bolster opening;

two wheel-sets operatively connected to the side frames, each wheel-set including an axle and two wheels disposed on the axle;

a bolster extending between the pair of side frames, the bolster having two end portions, each end portion of the bolster being disposed inside the bolster opening of a corresponding side frame;

at least one friction plate connected to the end portions of the bolster and extending generally vertically downwardly therefrom, the at least one friction plate being disposed generally at a longitudinal center of the bolster; and two suspension assemblies operatively connecting the end portions of the bolster to the side frames, each suspension assembly including:

at least one load supporting spring adapted to bias the car body upwardly;

a first wedge disposed on a first side of the at least one friction plate, the first wedge having a generally vertical face and a sloping face;

a first spring biasing the first wedge vertically downwardly into contact with a first frame sloping face provided in the bolster opening of the corresponding side frame such that the generally vertical face of the first wedge is pressed into contact with the at least one friction plate;

a second wedge disposed on a second side of the at least one friction plate opposite the first side, the second wedge having a generally vertical face and a sloping face; and a second spring biasing the second wedge vertically downwardly into contact with a second frame sloping face provided in the bolster opening of the corresponding side frame such that the generally vertical face of the second wedge is pressed into contact with the at least one friction plate.

2. The railway truck of claim 1, wherein the at least one friction plate is disposed generally at a longitudinal center of the side frames.

3. The railway truck of claim 1, wherein the first and second frame sloping faces of each side frame are defined in each side frame by the bolster openings.

4. The railway truck of claim 1, wherein for each side frame:

the first frame sloping face is formed by a third wedge connected to a first side of the bolster opening on the first side of the at least one friction plate; and the second frame sloping face is formed by a fourth wedge connected to a second side of the bolster opening on the second side of the at least one friction plate.

5. The railway truck of claim 1, wherein for each suspension assembly:

a slope of the first frame sloping face corresponds to a slope of the sloping face of the first wedge; and a slope of the second frame sloping face corresponds to a slope of the sloping face of the second wedge.

6. The railway truck of claim 1, wherein for each suspension assembly:

the first spring extends between and abuts the first wedge and a bottom surface of the corresponding end portion of the bolster; and the second spring extends between and abuts the second wedge and the bottom surface of the corresponding end portion of the bolster.

7. The railway truck of claim 1, wherein for each suspension assembly:

the first spring extends between and abuts the first wedge and a bottom surface of a first projection of the corresponding side frame; and the second spring extends between and abuts the second wedge and a bottom surface of a second projection of the corresponding side frame.

8. The railway truck of claim 1, further comprising:

at least one first wear plate connected to one side of the at least one friction plate; and at least one second wear plate connected to another side of the at least one friction plate;

wherein for each suspension assembly:

the vertical face of the first wedge is pressed into contact with the at least one first wear plate; and the vertical face of the second wedge is pressed into contact with the at least one second wear plate.

9. The railway truck of claim 1, wherein the at least one friction plate is integrally formed with the bolster; and wherein the bolster has a generally T-shaped cross-section.

10. The railway truck of claim 1, wherein a width of the at least one friction plate is less than a width of the bolster.

11. The railway truck of claim 1, further comprising one of a bracing system, a shear frame, and a frame structure connecting the side frames together.

12. The railway truck of claim 1, wherein for each suspension assembly, the at least one load supporting spring biases the corresponding end portion of the bolster upwardly.

13. A railway truck for supporting a car body comprising:

a pair of side frames, each side frame having a bolster opening, each bolster opening having a bottom wall;

two wheel-sets operatively connected to the side frames, each wheel-set including an axle and two wheels disposed on the axle;

a bolster extending between the pair of side frames, the bolster having two end portions, each end portion of the bolster being disposed inside the bolster opening of a corresponding side frame;

two friction plates connected to the bottom walls of the bolster openings and extending generally vertically upwardly therefrom; and two suspension assemblies operatively connecting the end portions of the bolster to the side frames, each suspension assembly including:

at least one load supporting spring adapted to bias the car body upwardly;

a first wedge disposed on a first side of a corresponding friction plate, the first wedge having a generally vertical face and a sloping face;

a first spring biasing the first wedge vertically upwardly into contact with a first bolster sloping face provided by the corresponding end portion of the bolster such that the generally vertical face of the first wedge is pressed into contact with the corresponding friction plate;

a second wedge disposed on a second side of the corresponding friction plate opposite the first side, the second wedge having a generally vertical face and a sloping face; and a second spring biasing the second wedge vertically upwardly into contact with a second bolster sloping face provided by the corresponding end portion of the bolster such that the generally vertical face of the second wedge is pressed into contact with the corresponding friction plate.

14. The railway truck of claim 13, wherein the two friction plates are disposed generally at a longitudinal center of the side frames.

15. The railway truck of claim 13, wherein the first and second bolster sloping faces of each end portion of the bolster are defined by the bolster.

16. The railway truck of claim 13, wherein for each suspension assembly:

a slope of the first bolster sloping face corresponds to a slope of the sloping face of the first wedge; and a slope of the second bolster sloping face corresponds to a slope of the sloping face of the second wedge.

17. The railway truck of claim 13, wherein for each suspension assembly:

the first spring extends between and abuts the first wedge and the bottom wall of the corresponding bolster opening; and the second spring extends between and abuts the second wedge and the bottom wall of the corresponding bolster opening.

18. The railway truck of claim 13, wherein for each suspension assembly:

the first spring extends between and abuts the first wedge and an upper surface of a first projection of the corresponding end portion of the bolster; and the second spring extends between and abuts the second wedge and an upper surface of a second projection of the corresponding end portion of the bolster.

19. The railway truck of claim 13, further comprising:

at least two first wear plates connected to one side of the two friction plates; and at least two second wear plates connected to another side of the two friction plates;

wherein for each suspension assembly:

the vertical face of the first wedge is pressed into contact with a corresponding one of the at least two first wear plates; and the vertical face of the second wedge is pressed into contact with a corresponding one of the at least two second wear plates.

20. The railway truck of claim 13, wherein the two friction plates are integrally formed with the side frames.

21. The railway truck of claim 13, wherein a width of each of the two friction plates is less than a width of the bolster.

22. The railway truck of claim 13, further comprising one of a bracing system, a shear frame, and a frame structure connecting the side frames together.

23. The railway truck of claim 13, wherein for each suspension assembly, the at least one load supporting spring biases the corresponding end portion of the bolster upwardly.

24. A railway truck for supporting a car body comprising:

a pair of side frames, each side frame having a bolster opening;

two wheel-sets operatively connected to the side frames, each wheel-set including an axle and two wheels disposed on the axle;

a bolster extending between the pair of side frames, the bolster having two end portions, each end portion of the bolster being disposed inside the bolster opening of a corresponding side frame;

at least one friction plate adapted for connection to the car body and for extending generally vertically downwardly therefrom, the at least one friction plate being disposed generally at a longitudinal center of the bolster; and two suspension assemblies operatively connecting the end portions of the bolster to the side frames, each suspension assembly including:

at least one load supporting spring adapted to bias the car body upwardly;

a first wedge disposed on a first side of the at least one friction plate, the first wedge having a generally vertical face and a sloping face;

a first spring biasing the first wedge vertically downwardly into contact with a first frame sloping face provided in the bolster opening of the corresponding side frame such that the generally vertical face of the first wedge is pressed into contact with the at least one friction plate;

a second wedge disposed on a second side of the at least one friction plate opposite the first side, the second wedge having a generally vertical face and a sloping face; and a second spring biasing the second wedge vertically downwardly into contact with a second frame sloping face provided in the bolster opening of the corresponding side frame such that the generally vertical face of the second wedge is pressed into contact with the at least one friction plate.

* * * * *